US011078592B2

(12) United States Patent
Gerhard

(10) Patent No.: US 11,078,592 B2
(45) Date of Patent: Aug. 3, 2021

(54) SELF-LUBRICATING ELECTROLYTICALLY DEPOSITED PHOSPHATE COATING

(71) Applicant: STAKU ANLAGENBAU GMBH, Lich (DE)

(72) Inventor: Jörg Gerhard, Lollar (DE)

(73) Assignee: STAKU ANLAGENBAU GMBH, Lich (DE)

( * ) Notice: Subject to any disclaimer, the term of this patent is extended or adjusted under 35 U.S.C. 154(b) by 267 days.

(21) Appl. No.: 16/066,471

(22) PCT Filed: Jan. 6, 2017

(86) PCT No.: PCT/EP2017/050240
§ 371 (c)(1),
(2) Date: Jun. 27, 2018

(87) PCT Pub. No.: WO2017/118716
PCT Pub. Date: Jul. 13, 2017

(65) Prior Publication Data

US 2019/0112724 A1 Apr. 18, 2019

(30) Foreign Application Priority Data

Jan. 8, 2016 (DE) ..... 10 2016 100 245.3

(51) Int. Cl.

| | |
|---|---|
| ***C25D 9/10*** | (2006.01) |
| ***C25D 11/36*** | (2006.01) |
| ***C25D 15/00*** | (2006.01) |
| ***C25D 7/06*** | (2006.01) |

(52) U.S. Cl.
CPC ..... *C25D 9/10* (2013.01); *C25D 7/0607* (2013.01); *C25D 11/36* (2013.01); *C25D 15/00* (2013.01)

(58) Field of Classification Search
None
See application file for complete search history.

(56) References Cited

U.S. PATENT DOCUMENTS

| | | | | |
|---|---|---|---|---|
| 4,728,398 | A | 3/1988 | Paulet et al. | |
| 6,346,186 | B1 | 2/2002 | Bjerrum et al. | |
| 2007/0295608 | A1* | 12/2007 | Hackenberg | C25D 11/36 205/318 |
| 2010/0120159 | A1* | 5/2010 | Lund | C25D 3/56 436/80 |

FOREIGN PATENT DOCUMENTS

| | | | |
|---|---|---|---|
| DE | 1644927 | B | 5/1971 |
| DE | 10348251 | A1 | 5/2005 |
| DE | 102006035974 | A1 | 2/2008 |
| DE | 19781959 | B4 | 9/2008 |
| EA | 012533 | B1 | 10/2009 |
| GB | 2028830 | A | 3/1980 |
| JP | S61502552 | A | 11/1986 |
| JP | H10147886 | A | 6/1998 |
| JP | 2002012983 | A | 1/2002 |
| KR | 20130073269 | A | 7/2013 |
| KR | 20140021556 | A | 2/2014 |
| RU | 2001126522 | A | 6/2003 |
| WO | WO-1986/06419 | A | 11/1986 |

* cited by examiner

*Primary Examiner* — Sheeba Ahmed
(74) *Attorney, Agent, or Firm* — Harness, Dickey & Pierce, P.L.C.

(57) ABSTRACT

The present disclosure relates to a self-lubricating, electrolytically deposited phosphate coating on metal workpieces, comprising stabilized solid lubricants incorporated into the phosphate coating and to a method for the production thereof.

8 Claims, No Drawings

SELF-LUBRICATING ELECTROLYTICALLY DEPOSITED PHOSPHATE COATING

CROSS-REFERENCE TO RELATED APPLICATIONS

This application is a National Stage of International Application No. PCT/EP2017/050240, filed on Jan. 6, 2017, and published in German as WO 2017/118716 A2 on Jul. 13, 2017. This application claims the priority to German Patent Application No. 10 2016 100 245.3, filed on Jan. 8, 2016. The entire disclosures of the above applications are incorporated herein by reference.

FIELD

The present disclosure relates to a self-lubricating, electrolytically deposited phosphating coating on metallic workpieces comprising stabilized solid lubricants embedded in the phosphating coating and a method for manufacturing the same.

BACKGROUND

This section provides background information related to the present disclosure which is not necessarily prior art.

Nowadays, the functionality of metallic workpieces can be expanded specifically by a variety of downstream processing steps. In particular, for modifying the surface properties industrial processes are provided which are able both to modify the aesthetics as well as the application characteristics such that more durable and visually more appealing products are available. In addition to abrading processes such as polishing and grinding for the further processing preferably coating processes are used, in which gaseous, liquid, dissolved or solid substances are used to build additional coherent layers on the workpiece. For fast coatings liquid, mainly aqueous systems are used from which dissolved substances can be deposited chemically or electrochemically. Examples of electrolytic coating processes are chromating, galvanic zinc coating and phosphating, wherein the latter is used when an increase of the corrosion resistance or a cold massive forming of the metallic base body is intended. In cold massive forming of metal workpieces due to the surface pressure, a high friction occurs between the tool and the workpiece which may result in local welding of the surfaces sliding on each other and subsequent damage of the workpiece and/or the tool. In order to reduce the friction, a phosphating layer is applied prior to the forming process, which typically contributes in combination with the application of further lubricants to reduce the friction during the following forming process. The sliding action of the phosphate layer itself is of only minor importance, more important is that this layer has a crystalline structure having a high porosity, which compared to untreated metal surfaces can absorb up to 13 times more lubricant, such as oil. Solid lubricants, too, adhere better on a phosphated metal surface than on blank steel. By means of this combination treatment of phosphating and subsequent oil/lubricant application the forces occurring during the cold forming can be reduced such that a reproducible machining process is enabled.

One possible method for phosphating metal layers, for example, is mentioned in DE 10348251 A1. Here electrolytic depositions from acidic aqueous solutions are disclosed, which include at least zinc and phosphate ions and are carried out with simultaneous supply of direct current.

Here, simultaneously with the deposition of the phosphating coating an electrolytic deposition of zinc in the same electrolyte takes place, wherein the current density is greater than −5 A/dm$^2$.

Another method for phosphating a metal layer by electrolytic deposition from acidic aqueous solutions, which include at least zinc and phosphate ions, is disclosed in DE 102006035974 A1. This document discloses metal layers which are coated with a zinc (zinc alloy)/zinc phosphate layer, wherein foreign particles were incorporated in the zinc (zinc alloy)/zinc phosphate layer.

DE 1644927 provides a method for producing dry lubricant-containing particles to be embedded in metal coatings to be deposited galvanically on workpieces which are exposed to sliding friction by incorporating them into the electrolyte and directing them against the surface of the workpiece connected as a cathode during the galvanic deposition, wherein finely divided powdered dry lubricant optionally together with silicon carbide or alumina particles as wear-resistant particles are stirred into a synthetic resin solution or into a silicate solution, which is optionally mixed with lime water, aluminum chloride or sulfuric acid as substances effecting a reaction into heavy soluble compounds, wherein the solvent is expelled from the mixture by evaporation and the residue is chopped mechanically to the desired particle size.

Another method of double phosphating, possibly also with use of a polymer in the phosphating solution is described in DE 19781959 B4. Subsequently to a first phosphating process the phosphated workpiece is exposed to a bath of 8.5 to 100 g/l $Ca^{+1}$, 0.5 to 100 g/l $Zn^{2+}$, 5 to 100 g/l $PO_4^{3-}$, 0 to 100 g/l $NO^{3-}$, 0 to 100 g/l $ClO^{3-}$and 0 to 50 g/l $F^-$ or $Cl^-$, to which polymers and solid lubricants are added to improve the frictional properties of the second phosphating layer.

The previous methods of applying solid lubricants on phosphating layers are complex and expensive and do in particular not allow to achieve high coating rates or to provide integrated solid lubricant particles within phosphating layers. It is therefore the object of the present disclosure to eliminate the drawbacks of the prior art and to provide in particular self-lubricating phosphating layers as well as methods for producing the same.

The features of the method according to the disclosure and the features of the phosphating layers according to the disclosure are specified in the independent claims. However, the dependent claims specify preferred embodiments of the method and the layers.

SUMMARY

This section provides a general summary of the disclosure, and is not a comprehensive disclosure of its full scope or all of its features.

According to the disclosure an electrolytically deposited phosphating layer at least comprising the elements zinc and phosphorous on a metallic workpiece is provided, wherein the phosphating layer comprises solid lubricant particles stabilized by hydrocolloids, wherein the stabilized solid lubricant particles are at least partially embedded in the phosphating layer. Surprisingly, it has been found that phosphating layers with the features mentioned above can be reproducibly deposited on workpieces and even high deposition rates result in coherent layers that can be processed without any problems in subsequent cold forming steps without additional anti-friction agents or lubricants. This discovery is surprising especially since it would have been expected that the incorporation of solid lubricant particles into the phosphating layer results in significant loss of quality of the deposited layer. These solid particles can have the consequence that the layer becomes mechanically destabilized or that no contiguous (coherent) layers are formed at all. In addition, it is surprising that these high-quality layers with incorporated lubricant particles can be obtained within conventional bath compositions and parameters. Thus, it is in particular possible to produce the layers according to the disclosure with identical or similar deposition rates, so that there are no or only minimal losses in the frame of the efficiency of the baths. Furthermore, it is of advantage that due to the incorporation of the lubricant particles the additional step of an anti-friction agent/lubricant particles application can be omitted so that the phosphated workpieces according to the present disclosure can be supplied to a mechanical cold forming process without further steps. Without being bound by theory, the quality-oriented deposition and the resulting stability of the additional solid lubricant-loaded phosphating layers result from the presence of the hydrocolloids in the phosphating bath. These hydrocolloids are apparently able to stabilize the solid lubricants in the solution in the form of coacervates by adding to the solid lubricant particles. These addition complexes can apparently contribute to a better distribution of the solid lubricant particles in the solution. In addition, these coacervates seem to be able to embed faster into the phosphating layer and with less interference of the layer structure compared to the non-stabilized particles. This results in a more uniform and coherent phosphating layer structure which is mechanically more stable in comparison with layers including non-stabilized particles.

A phosphating layer in the sense of the disclosure is an electrolytically deposited zinc phosphate coating on a metal workpiece. This can in principle be applied by known methods and is widespread for example for corrosion protection of low alloyed steels. In a pH-controlled precipitation reaction process zinc phosphate crystals (hopeite) by excess of their solubility product are deposited on the component surface during the phosphating. This may for example be achieved by pickling the base metal (e.g., $Fe \rightarrow Fe^{2+}+2e^{-}$), wherein the released electrons serve to reduce protons. Here, the pH value of the aqueous bath solution is shifted to a neutral to basic range and the solubility product of the zinc phosphate is exceeded. The forming layer is usually 2-20 μm thick and may have a degree of coverage of the component surface of about 90% to 95%, sometimes up to 100%.

The phosphating layer applied according to the disclosure is deposited electrolytically. This can be done either by applying a direct current or else by applying a pulsed direct current. Typical current densities are in a range of 0.1 and 250 $mA/cm^2$ and the bath temperatures can be selected in a range of 20 up to 90° C. Preferably, the temperature is between 25° C. and 80° C. The coating time, i.e. the time in which a current flows through the workpiece and metal ions are deposited from the solution onto the workpiece can be freely determined and may conveniently be between a few seconds, for example 1 second up to several minutes, such as for example 5 minutes. Suitably, the coating time is selected as a function of the concentration of the ions to be deposited, the desired layer thickness and the geometry of the workpiece. Thus, treatment times of modern systems for an electrolytic zinc coating and phosphating of steel strips are 90 to 120 m/min. This results in deposition times in the range of up to 5 seconds. In general, in this coating situation treatment times of 0.5 to 5 seconds can be used. In the most common applications the layer thickness of the phosphating layer may be 5 μm to 15 μm.

By means of the phosphating coatings according to the disclosure metallic workpieces can be obtained. The term metallic workpiece includes two- or three-dimensional structures of typically low-alloy steels. Likewise, however, these layers can also be applied onto stainless steels and other precious and base metals such as iron, Al, Ti, Cu, Ni or their alloys, as well as hot-dip galvanized materials. One-dimensional structures include for example wires, two-dimensional structures include for example strips or sheets and three-dimensional structures include for example complex shapes such as bearing shells. The metal workpieces can be single or multi-layered. Thus, it is in particular within the sense of the disclosure that the phosphating layer including stabilized solid lubricant particles can be applied onto a "normal" layer which is not equipped with stabilized solid lubricant particles.

The solid lubricant particles are stabilized both in the solution as well as highly probable in the phosphating layer by hydrocolloids. Here, the hydrocolloids have preferably a chain-like structure of individual, consecutive components. The hydrocolloids are capable to form viscous solutions in water by swelling under addition of water to the hydrocolloid framework. The hydrocolloids useable according to the disclosure may be composed of one and the same (homopolymer) or even of different components (heteropolymer). Here, the hydrocolloids can have a weight of preferably 1,000 to 1,000,000 Da. This particle size has proven to be particularly suitable for an effective interaction with the solid lubricant particles. Larger particles can interfere the incorporation of the lubricant particle into the layer and smaller hydrocolloid sizes can lead to a just insufficient stabilization of the lubricant particles and thus to mechanically unstable phosphating layers. Conveniently, the weight of the hydrocolloids can be determined on the basis of defined reference samples by gel permeation techniques. Suitable hydrocolloids are in particular water-soluble, that is swellable hydrocolloids. Examples are phenol sulphonate/formaldehyde condensates, polyvinyl alcohol, polyethers, polyacrylates and methacrylates, polyacrylam ides, polyvinylamines, polyamines, polyimines and their quaternary salts, polyvinyl pyrrolidones, polyvinyl pyridines, polyvinyl phosphonates and their copolymers, and natural hydrocolloids such as collagen, gelatine, chitosan hydrolyzate, keratin hydrolyzate, casein hydrolyzate, guar, pectins, agar-agar, starch and modified starch, cellulose derivatives such as carboxyalkyl cellulose or cellulose ethers, or blends and copolymers thereof.

By means of the hydrocolloids the solid lubricant particles are stabilized. This means that the solid lubricant particles come into contact with the swollen polymeric hydrocolloids within the aqueous solution and interact on the surface therewith. Here, it is in principle possible that the solid lubricant particles are stabilized both by interaction with the side chains or by contact with the backbone of the hydrocolloid. Without being bound by theory, an adsorption of the hydrocolloid particles on the lubricant surface occurs, wherein at least partially a polymer layer is formed around the solid lubricant. This adhering hydrocolloid layer is able to stabilize the lubricant particles in the solution and in the phosphating layer mechanically. In a preferred embodiment, it is possible that the deposited phosphating layer has a proportion of 15 to 60% by weight, further preferably from 20 to 40% by weight of solid lubricant particles. By means of this lubricant proportion a sufficient intrinsic lubrication can be obtained for many applications while maintaining good mechanical properties of the phosphating layer. The size of the stabilized solid lubricant particles may be in a range between 1.0 μm and 2 μm, preferably in a range from 0.5 μm to 3 μm. The size of the stabilized lubricant particles can be determined by dynamic laser light scattering or by microscopic methods. The weight ratio of the solid lubricant particles to the hydrocolloid can be varied within a wide range without leaving the area of an effective stabilization of the solid particle. Conveniently, the ratio may be varied from 100:1 to 1:100. This means that an effective stabilization of the lubricant particles can also be achieved if only a part of their surface is occupied by the hydrocolloids used according to the disclosure.

As a result of the electrolysis, the stabilized lubricant particles are, at least partially, embedded in the phosphating layer. According to the disclosure the stabilized solid lubricant particles are deposited not only on the surface or in the pores of the phosphating layer, but rather also in the phosphating layer. Consequently, a stabilized solid lubricant particle can be both entirely and partially surrounded by zinc phosphate. It is also possible that not every stabilized solid lubricant particle is permanently embedded in the layer, but that some of the stabilized solid lubricant particles are bound by adsorption on the workpiece surface. According to the disclosure after a single immersion of the workpiece without additional mechanical agitation in demineralised water at 20° C. for 1 minute at least 60% by weight, preferably 80% by weight and further preferably at least 90% by weight of the stabilized solid lubricant particles remain within the layer without being capable of being washed off. The total amount of stabilized solid lubricant particles can be determined by a dissolution of the material and subsequent quantitative elemental analysis. The amount of surface-bound only stabilized solid lubricant particles may be obtained from a determination of the concentration of the stabilized solid lubricant particles in the wash water. Alternatively, the percentage even of the washed/unwashed coated workpieces can be determined by means of quantitative radiographic methods such as ED-RFX.

Further areas of applicability will become apparent from the description provided herein. The description and specific examples in this summary are intended for purposes of illustration only and are not intended to limit the scope of the present disclosure.

In a first embodiment, the hydrocolloid may be a nitrogen-containing hydrocolloid. In particular, nitrogen-containing hydrocolloids seem to be able to form stable coacervates with the solid lubricant particles. These special coacervates enable a particularly sufficient stabilization of the solid lubricant particles in the solution and ensure a correct incorporation of the particles into the phosphating layer. Specifically, the nitrogen-containing hydrocolloids may therefore contribute to an effective deposition of the solid lubricant particles without affecting the deposition of the further phosphating components in a way leading to a reduction in quality. Without being bound by theory, in particular, the cationic charge of the N-hydrocolloid in the prevailing bath conditions seems to promote this deposition behaviour, wherein both the stabilization of the lubricant particles in the bath as well as the incorporation thereof in the phosphating layer are affected positively. As a result, a mechanically flexible and sufficiently stable encapsulation of the solid lubricants is obtained which do not interfere with the layer structure of the phosphating layer on the workpiece and can easily be released when subjected to mechanical stress in a cold forming process. In principle, it is possible that the hydrocolloid includes the nitrogen either in the side chains, at the hydrocolloid backbone or both. Preferably, the hydrocolloids may include nitrogen atoms both within the chain and at the side groups. The nitrogen atoms may also form different organic functional groups known to a person skilled in the art.

In another embodiment, the hydrocolloids can be selected from the group consisting of polyamines, polyimines and their quaternary salts, polyvinyl pyrrolidones, polyvinyl pyridines, collagen, gelatin, chitosan hydrolyzate, keratin hydrolyzate, casein hydrolyzate, amidopectines as well as copolymers and/or mixtures thereof. In particular, this group of nitrogen-containing hydrocolloids in combination with the most common solid lubricant particles leads to particularly strong interactions and thus to a particularly suitable mechanical stabilization of the solid lubricant particles and/or the resulting phosphating layer. Without being bound by theory, this may be in particular due to the molar ratio between nitrogen and the other components of the mentioned polymers and the swelling behavior of these hydrocolloids with the aqueous bath composition. Preferably, the hydrocolloid may include between 5 and 40 mol-%, further preferably at 10 to 30 mol-% nitrogen. These amounts of nitrogen in the hydrocolloid can lead to a sufficient swelling behavior under development of the hydrocolloid in the phosphating solution and thus contribute to a more rapid and effective interaction with the solid lubricant particles.

In another embodiment, the hydrocolloids may be selected from the group of vegetable or animal nitrogen-containing hydrocolloids consisting of gelatin, chitosan hydrolyzate, keratin hydrolyzate, casein hydrolyzate or mixtures thereof.

In another embodiment, the hydrocolloid is gelatin with a molecular weight of greater than or equal to 1,000 Da and less than or equal to 100,000 Da. Gelatin with a molecular weight in the range given above can undergo particularly stable complexes with solid lubricant particles. This can in particular be because gelatin swells particularly good in acidic phosphating baths and forms an almost entirely unfolded chain. This unfolded chain in turn is capable to particularly effectively interact with the solid lubricant particles and to stabilize them mechanically. Another reason for the particular stabilization could also be that gelatin carries nitrogen both in the basic structure as well as in the side chains. This division of the nitrogen can bind the hydrocolloid chain particularly quickly and effectively to the solid lubricant particles. Preferred molecular weight ranges for the gelatin are further between greater than or equal to 5,000 Da and less than or equal to 75,000 Da, more preferably between greater than or equal to 10,000 Da and less than or equal to 50,000 Da. Within these ranges high-quality phosphating layers can be obtained.

In an additional characteristic of the phosphating layer the solid lubricant particles may be selected from the group consisting of metal and ammonium salts of saturated fatty acids, $MoS_2$, h-BN, $WS_2$, graphite, oxidized and fluorinated graphite, PTFE, Nylon, PE, PP, PVC, PS PET, PUR, clay, talc, $TiO_2$, mullite, CuS, PbS, $Bi_2S_3$, CdS, or mixtures thereof. These compounds can be stabilized in a sufficient manner by the nitrogen-containing hydrocolloids in the chemical environment of a phosphating bath and be embedded in a sufficient amount in a phosphating layer, without disturbing the structure of the layer too much. Thereby coherent, stable phosphating layers are obtained which are provided with a sufficient amount of lubricant such that a further application of lubricant can be dispensed with in the course of a further mechanical processing. Advantageously, the lubricant particles are particulate. In particular, the particles without stabilization can have a size (largest distance within the lubricant particle) of greater than or equal to 10 nm and less than or equal to 10 μm, preferably greater than or equal to 25 nm and less than or equal to 5 μm, further preferably greater than or equal to 30 nm and less than or equal to 2.5 μm. These particle sizes can be incorporated without destroying the basic structure of the phosphating layer and provide sufficient amounts of lubricant. The size of the lubricant particles can be determined by methods known to a person skilled in the art, such as laser light scattering.

Furthermore, in a preferred characteristic the solid lubricant particles can consist of $MoS_2$ and may have a platelet-shaped geometry. Lubricant particles of molybdenum sulfide can be stabilized particularly effective by hydrocolloids and provide an embedding kinetics which can be controlled over a wide range. In this way sufficient amounts of lubricant particles can be embedded into layer depositions even under short current-carrying contact times. A very slight disturbance of the layer structure of the phosphating layer is obtained in particular when the particles have a platelet-shaped geometry. This geometry can lead to a higher load of the phosphating layer with lubricant particles and can provide an immediate lubricating effect during mechanical processing. The latter may be the case, since apparently the lubricant particles are embedded in the phosphating layer with their longitudinal sides parallel to the workpiece surface. The $MoS_2$ platelets then have a platelet-like geometry when the particle sizes are within the following limits: an average length selected from a range with a lower limit of 0.1 μm and an upper limit of 2 μm and a mean width selected from a range with a lower limit of 0.1 μm and an upper limit of 2 μm and a mean height selected from a range with a lower limit of 2 nm and an upper limit of 50 nm.

Moreover, according to the disclosure a method for producing a phosphating layer comprising stabilized solid lubricant particles is provided, comprising at least the steps:

a) providing a metallic workpiece;

b) immersing the metallic workpiece into an aqueous electrolyte solution comprising at least zinc, phosphate ions, solid lubricant particles and hydrocolloids;

c) passing an electric current through the metallic workpiece for depositing a phosphating layer onto the workpiece; and d) optionally post-treating the electrolytically deposited phosphating layer.

By means of this method coherent phosphating layers can be prepared which are provided with a sufficient amount of lubricant and also require no further lubricant additive in the course of a mechanical post-treatment. This method may also be carried out at high current densities such that high deposition rates and thus large layer thickness can be achieved in short process times. The method can be easily combined with the usual phosphating pretreatment steps such as alkaline cleaning with or without a surfactant and with or without intermediate rinsing.

The process is preferably a dipping method, the bath composition may further include accelerators, such as urea, nitrates, chlorates, bromates, hydrogen peroxide, ozone, organic nitro bodies, peroxy compounds, hydroxylamine, nitrite-nitrate, nitrate perborate or mixtures thereof. Preferably, the coating solution is an emulsion with emulsion droplets in the sub-micron range. The zinc phosphate solution may be adjusted to an acidic pH range through acids. As possible post-treatments, for example, rinsing with demineralized water or post-passivation by chromic acid, chromic acid/phosphoric acid solution or an organic post-passivation with poly(vinyl phenol) come into question.

Preferred bath parameters may be:

| | |
|---|---|
| temperature | ≥20 and ≤70° C. |
| pH value | ≥0.5 and ≤2.5 |
| Zn concentration | ≥10 and ≤70 g/l |
| phosphate concentration | ≥35 and ≤70 g/l |
| lubricant particle concentration | ≥2 and ≤25 g/l |
| hydrocolloid concentration | ≥0.01 and ≤5 g/l |
| Wetting agent concentration | ≥0.5 and ≤5 g/l |
| current density | ≥10 and ≤20 A/dm$^2$ |
| contact time | ≥1 and ≤15 s |

In a preferred embodiment of the process the phosphating layer comprising the stabilized solid lubricant particles may be deposited on a workpiece which comprises at the surface a phosphating layer with the elements ZnXP, wherein X is selected from the group consisting of Fe, Ni, Ca, Mn. The deposition of other metals from the above mentioned group may contribute to an additional mechanical stabilization of the phosphating layer. In this way, the percentage of lubricant may be increased, so that particularly effective self-lubricating workpieces can be obtained.

In an additional characteristic of the current-carrying contact time of a surface element of the workpiece with the aqueous electrolyte solution may be greater than or equal to 1 second and less than or equal to 100 seconds. The method according to the disclosure is particularly adapted to deposit a sufficiently thick phosphating coating on a metallic workpiece within short process times. For this reason, the current-carrying contact time, i.e. the time in which the workpiece is immersed in the bath and current passes through the workpiece, can be kept very short. This is particularly important for wires and straps, which are drawn at high speeds through the coating baths. In this time period the time is explicitly not included, in which constituents of the bath are still present on the surface of the workpiece, but no actual coating (deposition) takes place.

Within a further method aspect, the basis weight of the deposited phosphating layer comprising stabilized solid lubricant particles which is determined according to DIN EN ISO 3892 is greater than or equal to 0.5 g/m$^2$ and less than or equal to 10 g/m$^2$. In addition to the advantages already mentioned above, the incorporation of stabilized solid lubricant particles can result in that significantly lower basis weights can be obtained as compared to the usual phosphating methods. In this way, for example, costs for the use of coating metals can be saved. These basis weights provide sufficiently coherent and firmly adhering layers which can be partially destroyed only after significant mechanical stress and consequently release the lubricant. Preferably, the basis weight can also be greater than or equal to 0.75 g/m$^2$ and less than or equal to 8 g/m$^2$ and further preferably greater than or equal to 1.0 g/m$^2$ and less than or equal to 5.0 g/m$^2$.

In a further preferred aspect, the aqueous electrolyte solution may additionally comprise an anionic, cationic, amphoteric or non-ionic wetting agent in a concentration of greater than or equal to 0.1 and less than or equal to 10 g/l. The addition of this amount of wetting agent may result in that the stabilized solid lubricant particles are homogeneously distributed in the bath solution and as a whole a homogeneous application onto the metallic workpiece is achieved. Furthermore, the wetting agents contribute to an increase of the coating rate. This can contribute to a reduction in overall processing times.

In a further embodiment of the method, the phosphating solution may comprise a ratio of free acid to total acid (FSV, free acid ratio) of 2.5 and 10, and more preferably from ≥5.0 and ≤8.0. This ratio appears to lead to a particularly effective stabilization of the solid lubricant particles by the hydrocolloids. Without being bound by theory, this ratio can modify the zeta potential both of the solid lubricant particles and the hydrocolloids in such a way that both a particularly good stabilization of the particles in the solution and a particularly effective incorporation of the stabilized particles in the phosphating layer results. The titrimetric determination of the above mentioned ratio is known in the art.

Furthermore, metallic coated workpieces, at least comprising a self-lubricating phosphating layer comprising solid lubricant particles stabilized by hydrocolloids are in the sense of the disclosure.

In a further embodiment of the method this can also be used for treating draw-peeled workpieces, in particular draw-peeled wires. Here it may be in particular provided that the draw-peeled surface of the workpiece is activated electrochemically, e.g. by pickling, or mechanically, e.g. by abrasive blasting, brushing or grinding before a coating process according to the disclosure is carried out.

With respect to further advantages and features of the method described above it is hereby explicitly referred to the explanations in connection with the system according to the disclosure. Moreover, features and advantages of the layers according to the disclosure should also be applicable to the method according to the disclosure and are to be considered as disclosed and vice versa. The disclosure also covers all combinations of at least two of the features disclosed in the description and/or in the claims.

EXAMPLES

Example 1

A phosphated cold heading wire is produced, wherein a steel wire having a diameter of 10 mm is pulled for about 10 seconds through a phosphating solution of the following composition:

| | |
|---|---|
| Zinc: | 40 g/l |
| Phosphate: | 40 g/l |
| Acid ratio free acid:total acid: | 7.5 |
| pH value: | 1.2 |
| Gelatin | 0.2 g/l (hydrocolloid) |
| Wetting agent (BASF Crafol AP 261) | 0.2 g/l |
| Molybdenum disulfide particles (5 μm) | 6.0 g/l |

The temperature of the bath is about 55° C. and the strength of the direct current is approximately 12 A/dm$^2$. A phosphating layer having an average thickness of 4-8 g/m$^2$ is deposited which comprises embedded molybdenum sulfide particles. The phosphated cold heading wire is rinsed with water and subsequently drawn at a rate of 0.06 m/s in one step to a diameter of 7 mm. The drawing process is carried out without the addition of another lubricant. The wire can be drawn at a constant final diameter without any problems and no tearing of the wire or other loss of quality occurs.

Example 2

A phosphated cold heading wire is produced, wherein a cold heading wire having a diameter of 10 mm is pulled for approximately 2 seconds through a phosphating solution of the following composition:

| | |
|---|---|
| Zinc: | 45 g/l |
| Phosphate: | 40 g/l |
| Acid ratio of free acid:total acid: | 6.5 |
| PH value: | 1.2 |
| Polyethyleneimine G 35 BASF | 0.1 g/l (hydrocolloid) |
| Wetting agent (BASF Lutensol ON 110) | 0.5 g/l |
| Boron nitride particles 1 μm (Hebofill 410) | 5.5 g/l |

The other bath parameters correspond to those of Example 1. A phosphating layer with an average thickness of 6 g/m$^2$ is deposited, which comprises embedded boron nitride particles. The phosphated cold heading wire is rinsed with water and subsequently drawn in one step to a diameter of 7 mm. The drawing process is carried out without the addition of a further lubricant. The wire can be drawn at a constant final diameter without any problems and no tearing of the wire or other loss of quality occurs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A method for producing a phosphating layer comprising stabilized solid lubricant particles at least comprising the steps of:

a) providing a metallic workpiece;

b) immersing the metallic workpiece in an aqueous electrolyte solution comprising at least zinc, phosphate ions, solid lubricant particles and hydrocolloids;

c) passing an electric current through the metallic workpiece to deposit a phosphating layer on the workpiece; and d) optionally post-treating the electrolytically deposited phosphating layer, wherein the hydrocolloids are selected from the group consisting of polyamines, polyimines and theft quaternary salts, polyvinylpyrrolidones, polyvinylpyridines, collagen, gelatin, chitosan hydrolyzate, keratin hydrolyzate, casein hydrolyzate, amidopectins and their copolymers, and mixtures thereof, and wherein the solid lubricant particles consist of or include a substance which substance is at least one substance selected from the group consisting of metal salts of saturated fatty acids, ammonium salts of saturated fatty acids, molybdenum disulfide ($MoS_2$), hexagonal boron nitride (h-BN), tungsten disulfide ($WS_2$), graphite, oxidized and fluorinated graphite, polytetrafluoroethvlene (PTFE), nylon, polyethylene (PE), polypropylene (PP), polyvinylchloride (PVC), polystyrene (PS), polyethylene terephthalate (PET), polyurethane (PAIR), clay, talc, titanium dioxide ($TiO_2$), mullite, copper sulfide (CuS), lead sulfide (PbS), bismuth (HI) sulfide ($Bi_2S_3$), cadmium sulfide (CdS), and mixtures thereof.

2. The method according to claim 1, wherein the phosphating layer comprising stabilized solid lubricant particles is deposited on a first phosphating layer on the surface of a workpiece, said first phosphating layer comprises the elements ZnXP, wherein X is selected from the group including Fe, Ni, Ca, Mn.

3. The method according to claim 1, wherein the current-carrying contact time of a surface element of the workpiece with the aqueous electrolyte solution is greater than or equal to 1 second and less than or equal to 100 seconds.

4. The method according to claim 1, wherein the basis weight of the deposited phosphating layer comprising stabilized solid lubricant particles determined according to DIN EN ISO 3892 is greater than or equal to 0.5 $g/m^2$ and less than or equal to 10 $g/m^2$.

5. The method according to claim 1, wherein the aqueous electrolyte solution further comprises an anionic, cationic, amphoteric or non-ionic wetting agent in a concentration of greater than or equal to 0.1 and less than or equal to 10 g/I.

6. The method according to claim 1, wherein the metallic workpiece consists of a low alloy steel, iron, aluminum, titanium, copper, nickel, an alloy including iron, aluminum, titanium, copper or nickel or a hot zinc dipped material.

7. The method according to claim 1, wherein the workpiece is a workpiece obtained by draw-peeling.

8. The method according to claim 7, wherein the surface of the workpiece is pretreated mechanically or electrochemically prior to the coating process.

* * * * *